United States Patent [19]

Pollet et al.

[11] 3,982,947

[45] Sept. 28, 1976

[54] FOG-INHIBITORS FOR SILVER HALIDE PHOTOGRAPHY SILVER HALIDE PHOTOGRAPHIC MATERIAL CONTAINING AN IODO BENZENE COMPOUND AS ANTIFOGGANT

[75] Inventors: Robert Joseph Pollet, Vremde; Antoon Leon Vandenberghe, Hove, both of Belgium

[73] Assignee: AGFA-GEVAERT, N.V., Mortsel, Belgium

[22] Filed: Feb. 27, 1975

[21] Appl. No.: 553,622

[30] Foreign Application Priority Data

Mar. 14, 1974 United Kingdom ..... 11462/74

[52] U.S. Cl. ..... 96/109; 96/76 R

[51] Int. Cl.[2] ..... G03C 1/34

[58] Field of Search ..... 96/107, 76 R, 109

[56] References Cited

UNITED STATES PATENTS

| | | | |
|---|---|---|---|
| 2,776,211 | 1/1957 | Allen et al. | 96/109 |
| 3,499,761 | 3/1970 | Dersch et al. | 96/109 |
| 3,554,758 | 1/1971 | Willems et al. | 96/109 |
| 3,764,339 | 10/1973 | Himmelmann et al. | 96/109 |
| 3,885,967 | 5/1975 | Sashihara et al. | 96/109 |

*Primary Examiner*—Won H. Louie, Jr.
*Attorney, Agent, or Firm*—A. W. Breiner

[57] ABSTRACT

Photographic silver halide materials are described which comprise as antifogging agent a compound of the formula:

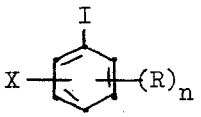

wherein:

X is a hydroxy or carboxy group or a substituent or fused-on azole heterocycle

*n* is 1 to 4, and

R is hydrogen, halogen, alkyl, alkoxy, alkoxycarbonyl, sulpho, aryl, fused-on benzene or X.

4 Claims, No Drawings

FOG-INHIBITORS FOR SILVER HALIDE PHOTOGRAPHY SILVER HALIDE PHOTOGRAPHIC MATERIAL CONTAINING AN IODO BENZENE COMPOUND AS ANTIFOGGANT

This invention relates to photographic light-sensitive silver halide emulsions comprising fog-inhibitors.

It is well known that light-sensitive silver halide materials comprising gelatin silver halide emulsion layers are subject to fogging. Fogging in general and chemical fogging in particular may be defined as the formation of a uniform deposit of silver on development which is dependent on a whole series of circumstances and factors namely on the nature of the emulsions, on their age, on the conditions under which they have been stored, on the development conditions, etc. For particular development conditions the fog tends to be higher when the time of storage and the temperature and relative humidity of the atmosphere in which the emulsions are stored are increased. Fog also increases with the degree of development and by rapid development at elevated temperatures.

A large variety of compounds have been described in the prior art for reducing fog formation in light-sensitive silver halide emulsions. These compounds can be used more or less successfully dependent on many circumstances e.g. the type and composition of emulsion in which they are used, so that there is still a need for novel types of fog inhibitors.

According to the present invention a photographic material is provided comprising a support and at least one silver halide emulsion layer containing per mole of silver halide from 0.1 to 10 millimoles of a fog inhibitor corresponding to the following general formula:

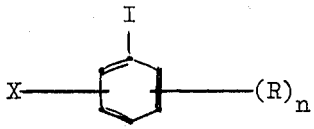

wherein:

X is a silver salt-forming hydroxy or carboxy group or a hydroxy or carboxy precursor group e.g. OM, COOM wherein M is ammonium or an alkali metal atom e.g. sodium, or a silver salt-forming or silver complex-forming azole heterocycle either as substituent or fused-on heterocycle e.g. imidazole, benzimidazole, naphthimidazole, pyrazole, triazole, tetrazole, indazole, etc.

*n* is 1 to 4, and each of R is hydrogen, or a member selected from the group consisting of fused-on benzene, alkyl e.g. methyl, alkoxy, e.g. methoxy, a group as represented by X, alkoxycarbonyl, sulpho in acid or salt form, halogen e.g. chlorine, bromine, iodine or aryl e.g. phenyl, $(R)_n$ should not be understood to represent a polymeric radical but should be understood to represent the number of sites of the benzene ring which can be substituted. It should further be understood that when *n* is greater than 1, the groups or atoms represented by R need not be identical.

The characterizing feature of the compounds corresponding to the above general formula is that they contain at least two coordinating groups for silver the iodine atom being one of these coordinating groups and the group represented by X forming the other coordinating group.

Representative examples of suitable compounds falling within the scope of the above general formula are listed in the following table together with literature references as to their preparation.

1.

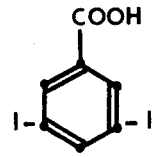

Am. Chem. Journal 43, 406

2.

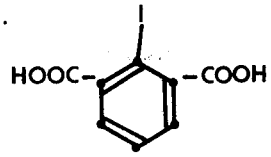

J. Am. Chem. Soc. 51, 3352 (1929)

3.

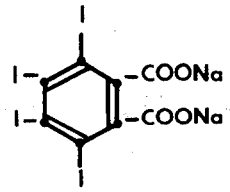

Ber. 29, 1634 (1896)

4.

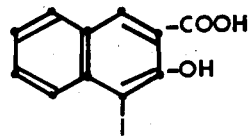

J. f. Prakt. Chem. [2] 89, 181 (1914)

5.

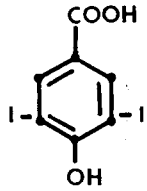

Org. Syntheses Coll. Vol. II, 343 (1946)

6.

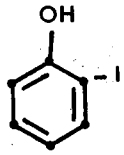

Org. Syntheses Coll. Vol. I, 319 (1932)

7.

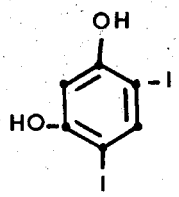

J. Am. Chem. Soc. 49, 1798 (1927)

8.

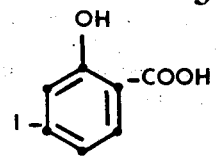

C.A. 68, 95466x (1968)

9.

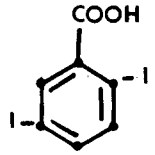

J.Org.Chem. 5, 230 (1940)

10.

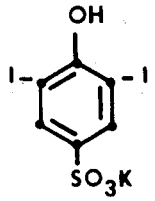

J.f. Prakt. Chem. [2] 37, 9 (1888)

11.

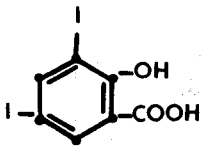

Org. Syntheses Coll. Vol.II 343 (1946)

12.

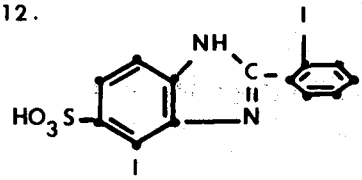

13.

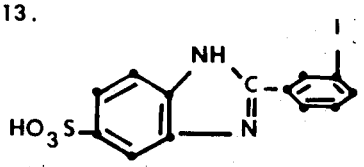

14.

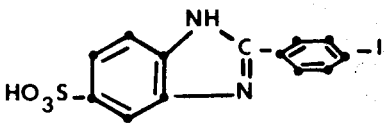

Compound 12 was prepared as follows:

18.8 g (0.1 mole) of 3,4-diaminobenzene sulphonic acid and 24.8 g (0.1 mole) of o-iodobenzoic acid were added with stirring at 100°C to 50 g of polyphosphoric acid. The reaction mixture was heated for 6 hours at 160°C whereupon it was cooled to room-temperature and admixed with 300 ml of ice-water. The precipitate formed was purified by dissolution in 5N sodium hydroxide, reprecipation with 5N hydrochloric acid and boiling with ethanol.

Yield: 10 g. Melting point: above 260°C.

In an analogous way were prepared: Compound 13 (yield: 13 g - melting point: above 260°C) and compound 14 (yield: 11 g - boiling point: above 260°C).

The antifoggants corresponding to the above formula may be incorporated into any type of light-sensitive silver halide emulsion e.g. an X-ray or other non-spectrally sensitized emulsion, a silver halide emulsion of use in diffusion transfer processes for the production of silver images, an orthochromatic, panchromatic or infrared-sensitive emulsion etc. They may be incorporated into high speed negative material as well as into rather low speed positive materials, in black-and-white emulsions as well as colour emulsions. Various silver salts may be used as light-sensitive salt e.g. silver bromide, silver iodide, silver chloride, or mixed silver halides e.g. silver chlorobromide or silver bromoiodide.

The silver halides can be dispersed in the common hydrophilic colloids such as gelatin, casein, zein, polyvinyl alcohol, carboxymethyl cellulose, alginic acid, etc. gelatin being, however, favoured.

The amount of compound according to the present invention employed in the light-sensitive silver halide material varies from about 0.1 to 10 millimoles, preferably from about 0.2 to about 5 millimoles per mole of silver halide. The way in which the antifoggants of use according to the invention are added to the emulsions is not critical and the addition can be made during no matter what step of emulsion preparation: they can be added before, during or after addition to the emulsion of spectral sensitizers, preferably just before coating of the emulsion on a suitable support such as for example paper, glass or film.

Instead of incorporating the antifoggants of the invention into the emulsion layer they can also be incorporated into another water-permeable colloid layer of the photographic material, e.g. a gelatin antistress layer or intermediate layer, which is in water-permeable relationship with the said emulsion layer.

The silver halide emulsions prepared in accordance with the present invention may be chemically sensitized by effecting the ripening in the presence of small amounts of sulphur-containing compounds such as allyl thiocyanate, allyl thiourea, sodium thiosulphate, etc. The emulsions may also be chemically sensitized by means of reductors for instance tin compounds as described in British Pat. No. 789,823, and small amounts of noble metal compounds such as gold, platinum, palladium, iridium, ruthenium and rhodium compounds as described by R. Koslowsky, Z. Wiss. Phot., 46, 65–72 (1951).

The emulsions may be spectrally sensitized or not. It is advantageous to sensitize them spectrally according to methods well known in the art to make them ortho-sensitized or pan-chromatically sensitized. Spectral sensitizers that can be used are e.g. the cyanines, merocyanines, complex (trinuclear) cyanines, complex (trinuclear) merocyanines, styryl dyes, oxonol dyes and the like. Suchlike spectrally sensitizing dyes have been described by F. M. Hamer in "The Cyanine dyes and related Compounds" (1954).

The emulsions may be hardened in the conventional way e.g. by means of formaldehyde, halogen-substituted aldehydes e.g. mucochloric acid and mucobromic acid, glutaraldehyde, diketones, dioxan derivatives, aziridine, oxypolysaccharides, methansulphonic acid esters, etc.

Other conventional addenda may be added to the emulsions e.g. plasticizers, coating aids, antistaining agents, developing agents, colour couplers, compounds that sensitize the emulsions by development acceleration, other fog-inhibitors and emulsion-stabilizing agents, etc.

Compounds that sensitize the emulsions by development acceleration are e.g. alkylene oxide polymers. These alkylene oxide polymers may be of various type e.g. polyethylene glycol having a molecular weight of 1500 or more, alkylene oxide condensation products or polymers as described among others in U.S. Pat. Nos. 1,970,578, 2,240,472, 2,423,549, 2,441,389, 2,531,832 and 2,533,990, in United Kingdom Pat. Specifications 920,637, 940,051, 945,340 and 991,608 and in Belgian Pat. No. 648,710. Other compounds that sensitize the emulsion by development acceleration and that may be used in combination with the foregoing polymeric compounds are quaternary ammonium and phosphonium compounds and ternary sulphonium compounds as well as onium derivatives of amino-N-oxides as described in United Kingdom Patent specification No. 1,121,696.

The emulsions may also comprise common antifoggants and emulsion stabilizers e.g. homopolar or salt-like compounds of mercury with aromatic and hterocyclic rings (e.g. mercaptotriazoles) simple mercury compounds, mercury sulphonium double salts and other mercury compounds of the kind described in Belgian Patent Nos. 524,121, 677,337, 707,386, and 709,195. Other suitable emulsion stabilizers are the azaindenes, particularly the tetra- or pentaazaindenes and especially those substituted by hydroxy- or amino groups. Suchlike compounds have been described by Birr in Z. Wiss. Phot. 47, 2–58 (1952). The emulsions may further comprise as stabilizers heterocyclic nitrogen-containing mercapto compounds such as benzothiazoline-2-thione and 1-phenyl-5-mercapto-tetrazole, sulphinic acids such as benzene sulphinic acid and toluene sulphinic acid, thiosulphonic acids such as benzene thiosulphonic acid, toluene thiosulphonic acid, p-chlorobenzene thiosulphonic acid sodium salt, propyl thiosulphonic acid potassium salt, butyl thiosulphonic acid, potassium salt, etc.

The following examples illustrate the fog-inhibiting action of the compounds corresponding to the above general formula:

EXAMPLE 1

A photographic ammoniacal silver bromoiodide gelatin emulsion (4.7 mole % of iodide) comprising per kg an amount of silver halide equivalent to 50 g of silver nitrate was divided into two aliquot portions.

To one of the portions, one of the fog-inhibitors according to the invention was added as listed in the table hereinafter. The emulsion portions were coated on a conventional support and dried.

The sensitometric values obtained after exposure and processing of a strip of the freshly prepared materials and of a strip of the materials which was stored for 5 days at 57°C and 34 % relative humidity are listed in the table.

The values I and II given for the speed are relative values corresponding to density 0.1 and 1 above fog respectively; the speed of the fresh material comprising no fog inhibitor of the invention is given the value 100.

Development occurred at 20°C for 5 min. in a developing solution having the following composition:

| | |
|---|---|
| water | 800 ccs |
| p-monomethylaminophenol sulphate | 1.5 g |
| sodium sulphite (anhydrous) | 50 g |
| hydroquinone | 6 g |
| sodium carbonate (anhydrous) | 32 g |
| potassium bromide | 2 g |
| water to make | 1000 ccs |

Table

| fog inhibitor per kg of emulsion | fresh material | | | | incubated material | | | |
|---|---|---|---|---|---|---|---|---|
| | fog | gamma | relative speed I | relative speed II | fog | gamma | relative speed I | relative speed II |
| none | 0.11 | 1.83 | 100 | 100 | 1.62 | 1.30 | 54 | 34 |
| 0.5 mmole of compound 6 | 0.10 | 2.02 | 44 | 60 | 0.22 | 1.99 | 49 | 54 |

EXAMPLE 2

This example was carried out in an analogous way as example 1 but with the difference that compound 8 was used as antifoggant instead of compound 6.

The results obtained were as follows.

Table

| fog inhibitor per kg of emulsion | fresh material | | | | incubated material | | | |
|---|---|---|---|---|---|---|---|---|
| | fog | gamma | relative speed I | relative speed II | fog | gamma | relative speed I | relative speed II |
| none | 0.22 | 1.60 | 100 | 100 | 1.09 | 1.15 | 73 | 41 |
| 3 mmole of compound 8 | 0.14 | 1.42 | 76 | 66 | 0.40 | 1.35 | 66 | 44 |

EXAMPLE 3

This example was carried out in an analogous way as Example 1 but with the difference that compound 11 was used as antifoggant instead of compound 6.

The results obtained were as follows.

Table

| fog inhibitor per kg of emulsion | fresh material fog | gamma | relative speed I | II | incubated material fog | gamma | relative speed I | II |
|---|---|---|---|---|---|---|---|---|
| none | 0.09 | 1.00 | 100 | 100 | 0.63 | 1.18 | 84 | 76 |
| 1 millimole of compound 12 | 0.07 | 1.62 | 41 | 73 | 0.17 | 1.40 | 87 | 100 |

EXAMPLE 4

This example was carried out in an analogous way as example 1 but with the difference that compound 7 was used as antifoggant instead of compound 6.

The results obtained were as follows.

Table

| fog inhibitor per kg of emulsion | fresh material fog | gamma | relative speed I | II | incubated material fog | gamma | relative speed I | II |
|---|---|---|---|---|---|---|---|---|
| none | 0.16 | 1.57 | 100 | 100 | 0.90 | 0.68 | 141 | 22 |
| 1 mmole of compound 7 | 0.10 | 1.81 | 44 | 49 | 0.38 | 1.27 | 90 | 57 |

EXAMPLE 5

A photographic acid silver bromoiodide gelatin emulsion (6 mole % of iodide) comprising per kg an amount of silver halide equivalent to 50 g of silver nitrate was divided into two aliquot portions.

To one of the portions, one of the fog-inhibitors according to the invention was added as listed in the table hereinafter. The emulsion portions were coated on a conventional support and dried.

The sensitometric values determined as described in example 1 are listed in the table.

Table

| fog inhibitor per kg of emulsion | fresh material fog | gamma | relative speed I | II | incubated material fog | gamma | relative speed I | II |
|---|---|---|---|---|---|---|---|---|
| none | 0.09 | 1.76 | 100 | 100 | 0.53 | 1.44 | 146 | 103 |
| 2 mmoles of compound 2 | 0.08 | 1.80 | 97 | 100 | 0.27 | 1.66 | 174 | 132 |

EXAMPLE 6

This example was carried out in an analogous way as example 5 but with the difference that compound 3 was used as antifoggant instead of compound 2.

The sensitometric values obtained were as follows:

Table

| fog inhibitor per kg of emulsion | fresh material fog | gamma | relative speed I | II | incubated material fog | gamma | relative speed I | II |
|---|---|---|---|---|---|---|---|---|
| none | 0.07 | 1.70 | 100 | 100 | 0.31 | 1.37 | 146 | 107 |
| 1 mmole of compound 3 | 0.07 | 1.70 | 81 | 79 | 0.11 | 1.37 | 103 | 84 |

EXAMPLE 7

This example was carried out in an analogous way as example 5 but with the difference that compound 4 was used as antifoggant instead of compound 2.

The sensitometric values obtained were as follows.

Table

| fog inhibitor per kg of emulsion | fresh material fog | gamma | relative speed I | II | incubated material fog | gamma | relative speed I | II |
|---|---|---|---|---|---|---|---|---|
| none | 0.08 | 1.48 | 100 | 100 | 0.44 | 1.45 | 200 | 127 |
| 3 mmoles of compound 4 | 0.08 | 1.71 | 60 | 62 | 0.16 | 1.64 | 100 | 81 |

EXAMPLE 8

This example was carried out in an analogous way as example 5 but with the difference that compound 14 was used as antifoggant instead of compound 2 and that development occurred for 3 min. instead of for 5 min.

The sensitometric results obtained were as follows:

Table

| fog inhibitor per kg of emulsion | fresh material fog | gamma | rel. speed I | II | incubated material fog | gamma | rel. speed I | II |
|---|---|---|---|---|---|---|---|---|
| none | 0.09 | 1.40 | 100 | 100 | 0.49 | 1.26 | 132 | 67 |
| 1 mmole of compound 11 | 0.09 | 1.43 | 94 | 94 | 0.35 | 1.35 | 111 | 83 |
| 2 mmoles of compound 11 | 0.08 | 1.37 | 84 | 84 | 0.27 | 1.31 | 115 | 83 |

The tables hereinbefore show that the compounds employed in this invention are highly useful as fog inhibitors with respect to silver halide layers. In the case of the incubated samples which incorporate a compound employed in this invention, it should be noted that gamma and speed are generally superior to that sample which does not contain the fog-inhibitor.

We claim:

1. A photographic material comprising a support and at least one light-sensitive silver halide emulsion layer wherein the material comprises per mole of silver halide from about 0.1 to 10 millimoles of a fog-inhibitor corresponding to the following general formula:

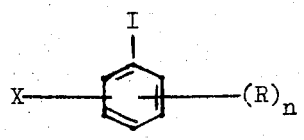

wherein:

X is a silver salt forming hydroxy or carboxy group or a hydroxy or carboxy precursor group or a silver salt or silver complex forming substituent azole heterocycle,

*n* is 1 to 4, and

R stands for hydrogen or a member selected from the group consisting of alkyl, alkoxy, fused-on benzene, aryl, halogen, alkoxycarbonyl, sulpho in acid or salt form, or a group as represented by X.

2. A photographic material according to claim 1, wherein X is hydroxy and R is hydrogen, carboxy, hydroxy or iodine.

3. A photographic material according to claim 1, wherein X is carboxy and R is hydrogen, carboxy, hydroxy or iodine.

4. A photographic material according to claim 1, wherein the fog inhibitor is present in the silver halide emulsion layer.

* * * * *